US007152577B2

(12) United States Patent
Nakagawa

(10) Patent No.: US 7,152,577 B2
(45) Date of Patent: Dec. 26, 2006

(54) THROTTLE BODY FOR V-TYPE ENGINE

(75) Inventor: Mitsuyuki Nakagawa, Kawasaki (JP)

(73) Assignee: Keihin Corporation (JP)

( * ) Notice: Subject to any disclaimer, the term of this patent is extended or adjusted under 35 U.S.C. 154(b) by 0 days.

(21) Appl. No.: 11/333,270

(22) Filed: Jan. 18, 2006

(65) Prior Publication Data

US 2006/0157021 A1 Jul. 20, 2006

(30) Foreign Application Priority Data

Jan. 18, 2005 (JP) ..... 2005-010501

(51) Int. Cl.
*F02M 61/14* (2006.01)
*F02M 55/02* (2006.01)
*F02D 9/10* (2006.01)

(52) U.S. Cl. ..... 123/336; 123/468; 123/469; 123/470

(58) Field of Classification Search ..... 123/336, 123/445, 456, 468, 469, 470, 472
See application file for complete search history.

(56) References Cited

U.S. PATENT DOCUMENTS

2002/0185323 A1* 12/2002 Tsutsumi et al. ..... 180/219

FOREIGN PATENT DOCUMENTS

| | | | |
|---|---|---|---|
| EP | 000423813 | A1 * | 4/1991 |
| EP | 1630382 | A1 * | 3/2006 |
| JP | 03081554 | A * | 4/1991 |
| JP | 05-248317 | | 9/1993 |

* cited by examiner

*Primary Examiner*—T. M. Argenbright
(74) *Attorney, Agent, or Firm*—Bacon & Thomas PLLC

(57) ABSTRACT

To improve design freedom of fuel supply piping in a V-type engine, and avoid heat from cylinders, first and second fuel distribution pipes (8, 9) are arranged in one side walls (1*a*, 3*e*) and the other side walls (1*h*, 3*a*) respectively of first and second throttle bodies (1, 3), first and second fuel injection valves (J1, J2) are held to the one side wall (1*a*) and the other side wall (3*a*) respectively, first and second fuel connection pipe portions (8*e*, 9*e*) protrude toward the other direction X from a first fuel passage boss portion (8*a*) of the first fuel distribution pipe (8), and one direction Y from a second fuel passage boss portion (9*a*) of the second fuel distribution pipe (9) respectively, and the first and second fuel connection pipe portions (8*e*, 9*e*) are connected to a fuel coupling pipe (13) above inflow ends (1*g*, 3*g*) of the first and second throttle bodies and between facing walls (1*d*, 3*d*).

3 Claims, 14 Drawing Sheets

Y X

Y X

THROTTLE BODY FOR V-TYPE ENGINE

TECHNICAL FIELD

The present invention relates to a throttle body for a V-type engine in which a plurality of cylinders are arranged so as to form a V bank and throttle bodies connected to the respective cylinders are arranged within the V bank.

BACKGROUND ART

The throttle body for the V-type engine is shown in Japanese Unexamined Patent Publication No. 5-248317 (Patent Document 1).

A description will be given on the basis of reference symbols described in the publication. A throttle body 29 provided with an upper suction air passage 31*a* and a lower suction air passage 31*b* is arranged within a V bank of an upper cylinder and a lower cylinder constituting the V-type engine, an upper fuel injection valve 33*a* is arranged in an upper side wall of the upper suction air passage 31*a*, and a lower fuel injection valve 33*b* is arranged in a lower side wall of the lower suction air passage 31*b*.

Further, fuel within a fuel tank is boosted by a fuel pump 47, the boosted fuel is supplied to the upper fuel injection valve 33*a* via an upper fuel supply hose 48. On the other hand, the boosted fuel is supplied to the lower fuel injection valve 33*b* via a lower fuel supply hose 51.

DISCLOSURE OF THE INVENTION

Problem to be Solved by the Invention

In accordance with the conventional throttle body for the V-type engine, the upper fuel supply hose supplying the fuel to the upper fuel injection valve extends between the upper suction air passage and the upper cylinder while bending after passing through a left side of the throttle body, and is then connected to the upper fuel injection valve.

Further, the lower fuel supply hose supplying the fuel to the lower fuel injection valve extends between the lower suction air passage and the lower cylinder while bending after passing through the left side of the throttle body, and is then connected to the lower fuel injection valve.

In the case that the upper and lower fuel supply hoses are arranged while bypassing outer sides of the respective suction air passages as mentioned above, hose lengths of the upper and lower fuel supply hoses become long, so that a freedom for designing a piping of the fuel supply hose is limited.

Further, a locking member is required for suppressing a vibration of the long fuel supply hose at a time of engine operation.

Further, since the upper fuel supply hose is arranged close to the upper cylinder and the lower fuel supply hose is arranged close to the lower cylinder, the fuel circulating within the fuel supply hoses tends to be warmed up by the cylinder, and there is a risk that a vapor is generated particularly at a time of continuous engine operating in summer.

A throttle body for a V-type engine in accordance with the present invention is made by taking the problem mentioned above into consideration, and a main object of the present invention is to improve a design freedom of a fuel piping of a fuel supply hose supplying fuel to a fuel injection valve installed to each of throttle bodies connected to cylinders constituting the V-type engine, and to provide the throttle body having a fuel supply hose which is hard to be affected by heat generated in the cylinders during engine operation.

Means for Solving the Problem

In order to achieve the object mentioned above, in accordance with a first aspect of the present invention, there is provided a throttle body for a V-type engine comprising:

a first throttle body in which a first suction air passage is provided through;

a second throttle body in which a second suction air passage is provided through, the first throttle body and the second throttle body being arranged adjacently in sideward parallel to each other;

a throttle valve shaft arranged so as to penetrate across the first suction air passage and the second suction air passage;

a first throttle valve opening and closing the first suction air passage;

a second throttle valve opening and closing the second suction air passage, the first throttle valve and the second throttle valve being attached to the throttle valve shaft;

a first fuel injection valve which is open toward a suction air passage in a downstream side of the first throttle valve, and is attached to one side wall of the first throttle body; and a second fuel injection valve which is open toward a suction air passage in a downstream side of the second throttle valve, and is attached to the other side wall of the second throttle body, wherein a first fuel distribution pipe is formed by a first fuel passage boss portion formed toward a side portion, a first fuel injection valve support boss portion formed so as to protrude toward an upper side from the first fuel passage boss portion, first and second mounting collar portions protruding toward the other side portion X from the first fuel passage boss portion and having a mounting hole provided therein, and a first fuel connection pipe portion protruding toward the other side portion X from the first fuel passage boss portion, wherein a first fuel passage 8*g* is provided in the first fuel passage boss portion toward a side portion, wherein a first injection valve insertion hole connected to the first fuel passage and open toward an upper end is provided in the first fuel injection valve support boss portion 8*b*, wherein a first fuel connection path is provided in the first fuel connection pipe portion from a leading end toward the first fuel passage, wherein a second fuel distribution pipe is formed by a second fuel passage boss portion formed toward a side portion, a second fuel injection valve support boss portion formed so as to protrude toward an upper side from the second fuel passage boss portion, third and fourth mounting collar portions protruding toward one side portion Y from the second fuel passage boss portion and having a mounting hole provided therein, and a second fuel connection pipe portion protruding toward the one side portion Y from the second fuel passage boss portion, wherein a second fuel passage is provided in the second fuel passage boss portion toward a side portion, wherein a second injection valve insertion hole connected to the second fuel passage and open toward an upper end is provided in the second fuel injection valve support boss portion, wherein a second fuel connection path is provided in the second fuel connection pipe portion from a leading end toward the second fuel passage, wherein an inflow side end portion of the first fuel injection valve is arranged so as to be inserted into the first injection valve insertion hole of the first fuel injection valve support boss portion by arranging the first fuel distribution pipe so as to face to the one side walls of the first and second throttle bodies and fixing by screw to the one side walls of the first and second throttle bodies via the mounting holes of the first and second mounting collar portions, wherein the first fuel connection pipe portion is arranged above inflow ends of the first and second throttle bodies and between facing walls of the first and second throttle bodies, wherein an inflow side end portion of the second fuel injection valve is arranged so as to be inserted into the second injection valve insertion hole of the second fuel injection valve support boss portion by arranging the second fuel distribution pipe so as to face to the other side walls of the first and second throttle bodies and fixing by screw to the other side walls of the first and second throttle bodies via the mounting holes of the third and fourth mounting collar portions, wherein the second fuel connection pipe portion is arranged above inflow ends of the first and second throttle bodies and between the facing walls of the first and second throttle bodies, wherein a fuel inflow pipe connected to a fuel pump is arranged so as to be connected to an opening portion to an end portion of the first fuel passage boss portion in the first fuel passage, and wherein the first and second fuel connection pipe portions are arranged so as to be connected by a fuel coupling pipe.

Further, in accordance with a second aspect of the present invention, there is provided a throttle body for a V-type engine comprising:

a first throttle body in which a first suction air passage is provided through;

a second throttle body in which a second suction air passage is provided through, the first throttle body and the second throttle body being arranged adjacently in sideward parallel to each other;

a throttle valve shaft arranged so as to penetrate across the first suction air passage and the second suction air passage;

a first throttle valve opening and closing the first suction air passage;

a second throttle valve opening and closing the second suction air passage, the first throttle valve and the second throttle valve being attached to the throttle valve shaft;

a first fuel injection valve which is open toward a suction air passage in a downstream side of the first throttle valve and is attached to one side wall of the first throttle body; and a second fuel injection valve which is open toward a suction air passage in a downstream side of the second throttle valve and is attached to the other side wall of the second throttle body, wherein a first fuel distribution pipe is formed by a first fuel passage boss portion formed toward a side portion, a first fuel injection valve support boss portion formed so as to protrude toward an upper side from the first fuel passage boss portion, first and second mounting collar portions protruding toward the other side portion X from the first fuel passage boss portion and having a mounting hole provided therein, and a first fuel connection pipe mounting boss portion protruding toward an upper side from the first fuel passage boss portion and forming a first mounting surface in an upper portion thereof, wherein a first fuel passage is provided in the first fuel passage boss portion toward a side portion, wherein a first injection valve insertion hole connected to the first fuel passage and open toward an upper end is provided in a first fuel injection valve support boss portion, wherein a first fuel connection pipe insertion hole connected to the first fuel passage and a thread hole are provided in the first mounting surface of the first fuel connection pipe mounting boss portion, wherein the first fuel connection pipe is provided with a collar portion, a first insertion boss protruding toward a lower side from the collar portion and a first fuel outlet pipe portion protruding toward the other side portion X from the collar portion, wherein a first fuel connection path is provided toward a leading end of the first fuel outlet pipe portion from a lower end of the first insertion boss, wherein a mounting hole is provided in the collar portion, wherein a second fuel distribution pipe is formed by a second fuel passage boss portion formed toward a side portion, a second fuel injection valve support boss portion formed so as to protrude toward an upper side from the second fuel passage boss portion, third and fourth mounting collar portions protruding toward one side portion Y from the second fuel passage boss portion and having a mounting hole provided therein, and a second fuel connection pipe mounting boss portion protruding toward an upper side from the second fuel passage boss portion and forming a second mounting surface in an upper portion thereof, wherein a second fuel passage is provided in the second fuel passage boss portion toward a side portion, wherein a second injection valve insertion hole connected to the second fuel passage and open toward an upper end is provided in a second fuel injection valve support boss portion, wherein a second fuel connection pipe insertion hole connected to the second fuel passage and a thread hole are provided in the second mounting surface of the second fuel connection pipe mounting boss portion, wherein the second fuel connection pipe is provided with a collar portion, a second insertion boss protruding toward a lower side from the collar portion and a second fuel outlet pipe portion protruding toward the one side portion from the collar portion, wherein a second fuel connection path is provided toward a leading end of the second fuel outlet pipe portion from a lower end of the second insertion boss, wherein a mounting hole is provided in the collar portion, wherein an inflow side end portion of the first fuel injection valve is arranged so as to be inserted into the first injection valve insertion hole of the first fuel injection valve support boss portion by arranging the first fuel distribution pipe so as to face to the one side walls of the first and second throttle bodies and fixing by screw to the one side walls of the first and second throttle bodies via the mounting holes of the first and second mounting collar portions, wherein the first insertion boss of the first fuel connection pipe is fixedly arranged so as to be inserted into the first fuel connection pipe insertion hole by screwing the collar portion of the first fuel connection pipe onto the first mounting surface of the first fuel distribution pipe, wherein an inflow side end portion of the second fuel injection valve is arranged so as to be inserted into the second injection valve insertion hole of the second fuel injection valve support boss portion by arranging the second fuel distribution pipe so as to face to the other side walls of the first and second throttle bodies and fixing by screw to the other side walls of the first and second throttle bodies via the mounting holes of the third and fourth mounting collar portions, wherein the second insertion boss of the second fuel connection pipe is fixedly arranged so as to be inserted into the second fuel connection pipe insertion hole by screwing the collar portion of the second fuel connection pipe onto the second mounting surface of the second fuel distribution pipe, wherein a fuel inflow pipe connected to a fuel pump is arranged so as to be connected to an opening portion to an end portion of the first fuel passage boss portion in the first fuel passage, and wherein the first fuel outlet pipe portion and the second fuel outlet pipe portion arranged in an upper side from the inflow ends of the first and second throttle bodies and so as to face to each other between the facing walls of the first and second throttle bodies are connected to a fuel coupling pipe.

Further, in accordance with a third aspect of the present invention, in addition to the first aspect mentioned above, the mounting hole provided in the first mounting collar portion of the first fuel distribution pipe is formed in a right side of the first fuel connection pipe portion and along a longitudinal axis of the first injection valve insertion hole of the first fuel injection valve support boss portion, the mounting hole provided in the second mounting collar portion is formed in a left side of the first fuel connection pipe portion, the mounting hole provided in the third mounting collar portion of the second fuel distribution pipe is formed in a left side of the second fuel connection pipe portion and along a longitudinal axis of the second injection valve insertion hole of the second fuel injection valve support boss portion, and the mounting hole provided in the fourth mounting collar portion is formed in a right side of the second fuel connection pipe portion.

In accordance with the first aspect of the present invention, the first fuel injection valve is attached to the first throttle body by the first fuel distribution pipe fixed by screw to the one side walls of the first and second throttle bodies, and the second fuel injection valve is attached to the second throttle body by the second fuel distribution pipe fixed by screw to the other side walls of the first and second throttle bodies.

On the other hand, the first fuel connection pipe portion formed in the first fuel distribution pipe and the second fuel connection pipe portion formed in the second fuel distribution pipe are arranged above the inflow ends of the first and second throttle bodies and so as to face to each other within the facing walls of the first and second throttle bodies, and the first and second fuel connection pipe portions are arranged so as to be connected by the fuel coupling pipe.

In accordance with the structure mentioned above, since the fuel coupling pipe connecting the first fuel distribution pipe and the second fuel distribution pipe by a flow path is arranged at an upper position from the inflow ends of the first and second throttle bodies, and is arranged between the facing walls of the first and second throttle bodies, that is, arranged within a space between the first and second throttle bodies, the fuel coupling pipe can be arranged freely without interfering with the other members, and it is possible to improve a freedom of a layout design of the fuel coupling pipe.

Further, since the longitudinal axial direction of the fuel coupling pipe can be arranged apart from each of the cylinders forming the V-type engine, the fuel coupling pipe is hard to be affected by heat generated in the cylinder.

Further, since the first fuel connection pipe portion is integrally formed with the first fuel distribution pipe and the second fuel connection pipe portion is integrally formed with the second fuel distribution pipe, it is not necessary to prepare the first and second fuel connection pipes as single units, whereby it is possible to reduce the number of parts. Further, it is not necessary to firmly fix each of the first and second fuel connection pipes to the throttle body, whereby it is possible to improve a mounting workability.

Further, since the fuel coupling pipe is arranged within the space between the first and second throttle bodies as mentioned above, there is no risk that the external obstacles come into collision with the fuel coupling pipe so as to damage the fuel coupling pipe. In addition, since the fuel coupling pipe is not exposed to the external, it is possible to improve an outer appearance of the throttle body.

The above matter is particularly preferable for a two-wheeled vehicle in which an engine is directly exposed to the atmospheric air.

Further, in accordance with the second aspect of the present invention, the first fuel distribution pipe is fixed by screw to the one side walls of the first and second throttle bodies, the first fuel injection valve is attached to the one side wall of the first throttle body, the second fuel distribution pipe is fixed by screw to the other side walls of the first and second throttle bodies, and the second fuel injection valve is attached to the other side wall of the second throttle body.

Further, the first fuel outlet pipe portion of the first fuel connection pipe and the second fuel outlet pipe portion of the second fuel connection pipe are previously connected by the fuel coupling pipe, and can be formed in a sub assembly state, and under this state, the first fuel connection pipe is screwed to the first fuel connection pipe mounting boss portion of the first fuel distribution pipe and the second fuel connection is screwed to the second fuel connection pipe mounting boss portion of the second fuel distribution pipe.

In accordance with the structure mentioned above, the fuel coupling pipe can be extremely easily mounted to the portion between the facing walls of the first and second throttle bodies.

Further, since a maintenance of the fuel coupling pipe having a long passage length can be executed by detaching the first and second fuel connection pipes from the first and second fuel distribution pipes without detaching the first and second fuel distribution pipes from the first and second throttle bodies, it is possible to largely improve a maintenance workability of the fuel coupling pipe.

Further, in accordance with the third aspect of the present invention, the first fuel distribution pipe is screwed to the one side walls of the first and second throttle bodies via the mounting holes provided in the first and second mounting collar portions.

Since the mounting hole of the first mounting collar portion is formed in the right side of the first fuel connection pipe portion and on the longitudinal axis of the first injection valve insertion hole, and the mounting hole of the second mounting collar portion is formed in the left side of the first fuel connection pipe portion in this structure, the first fuel distribution pipe does not bend even in the case that the external force is applied to the first fuel distribution pipe at a time of attaching the fuel coupling pipe to the first fuel connection pipe portion, whereby it is possible to well maintain the insertion and support of the inflow side end portion of the first fuel injection valve by the first injection valve support hole of the first fuel distribution pipe.

Further, the second fuel distribution pipe is screwed to the other side walls of the first and second throttle bodies via the mounting holes provided in the third and fourth mounting collar portions.

Since the mounting hole of the third mounting collar portion is formed in the left side of the second fuel connection pipe portion and on the longitudinal axis of the second injection valve insertion hole, and the mounting hole of the fourth mounting collar portion is formed in the right side of the second fuel connection pipe portion in this structure, the second fuel distribution pipe does not bend even in the case that the external force is applied to the second fuel distribution pipe at a time of attaching the fuel coupling pipe to the second fuel connection pipe portion, whereby it is possible to well maintain the insertion and support of the inflow side end portion of the second fuel injection valve by the second injection valve support hole of the second fuel distribution pipe.

Further, since the mounting hole of the first mounting collar portion is formed on the longitudinal axis of the first injection valve insertion hole, it is possible to more accurately and securely insert and arrange the inflow side end portion of the first fuel injection valve in the first injection valve support hole.

Further, since the mounting hole of the third mounting collar portion is formed on the longitudinal axis of the second injection valve insertion hole, it is possible to more accurately and securely insert and arrange the inflow side end portion of the second fuel injection valve in the second injection valve support hole.

BEST MODE FOR CARRYING OUT THE INVENTION

Figure 1:
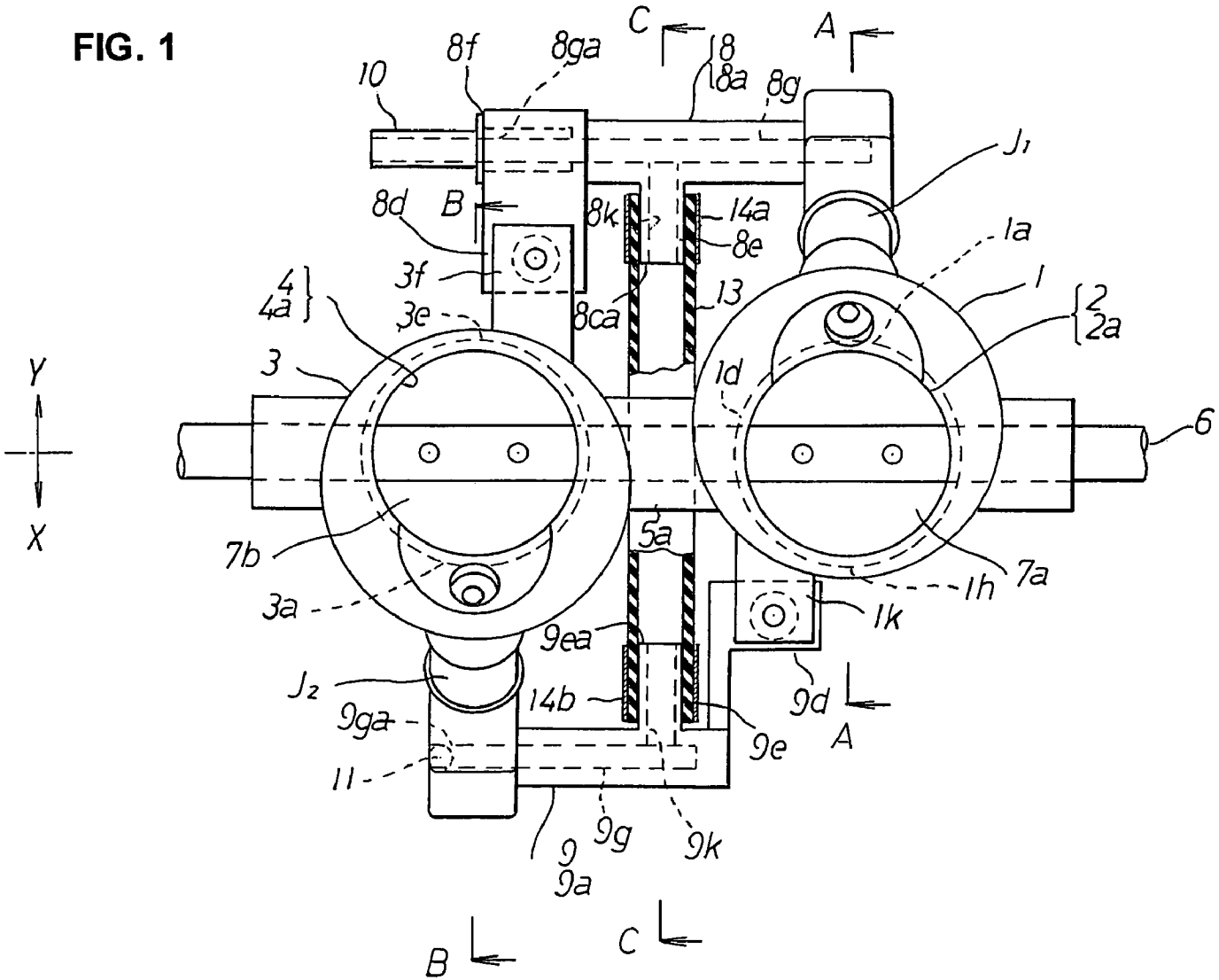
FIG. 1 is a top plan view showing an embodiment of a throttle body for a V-type engine in accordance with the present invention.

A description will be given below of embodiments of a throttle body for a V-type engine in accordance with the present invention with reference to the accompanying drawings.

The present embodiments relate to a throttle body for a V-type two-cylinder engine.

Reference numeral 1 denotes a first throttle body provided in such a manner that a first suction air passage 2 passes through an inner portion along a vertical direction. The first throttle body 1 is structured such that a first injection valve leading end insertion hole 1*b* is provided in one side wall 1*a* of the first throttle body 1 (a right side wall of the throttle body 1 in FIG. 2) toward a left oblique upper side, and an upper end of the first injection valve leading end insertion hole 1*b* is open toward an inner side of a suction air passage 2*a* at a downstream side from a first throttle valve mentioned below. In the following description, upstream and downstream sides are based on an air flow direction.

Further, a first mounting step portion 1*c* forming a flat surface is formed in the one side wall 1*a* of the first throttle body 1 and in a lower side of the first injection valve leading end insertion hole 1*b*.

Reference numeral 3 denotes a second throttle body provided in such a manner that a second suction air passage 4 passes through an inner portion along a vertical direction. The second throttle body 3 is structured such that a second injection valve leading end insertion hole 3*b* is provided in the other side wall 3*a* of the second throttle body 3 (a left side wall of the throttle body 3 in FIG. 3) toward a right oblique upper side, and an upper end of the second injection valve leading end insertion hole 3*b* is open toward an inner side of a suction air passage 4*a* at a downstream side from a second throttle valve mentioned below.

Further, a second mounting step portion 3*c* forming a flat surface is formed in the other side wall 3*a* of the second throttle body 3 and in a lower side of the second injection valve leading end insertion hole 3*b*.

The first throttle body 1 and the second throttle body 3 are arranged adjacently in sideward parallel to each other. In the present embodiment, facing walls 1*d* and 3*d* of the first throttle body 1 and the second throttle body 3 are coupled by an upper connection portion 5*a* and a lower connection portion 5*b*, and the first throttle body 1, the second throttle body 3, the upper connection portion 5*a* and the lower connection portion 5*b* are integrally formed in accordance with an injection molding.

Figure 4:
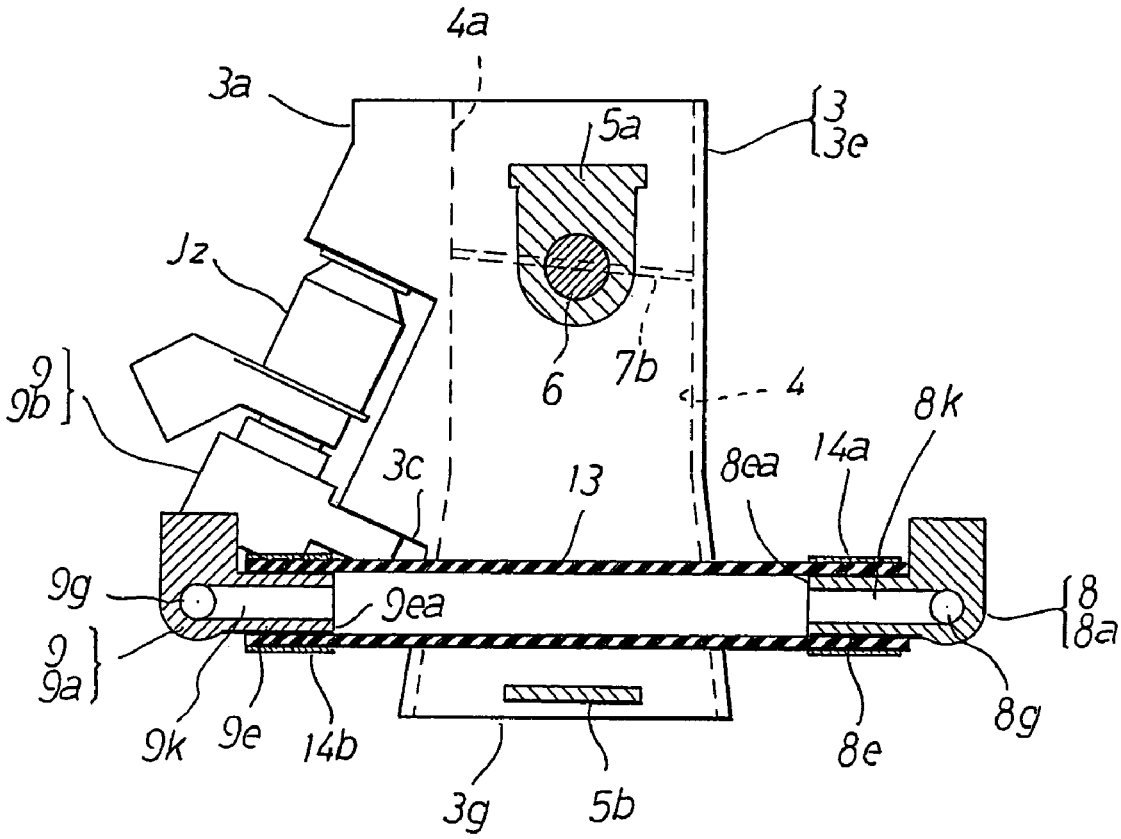
FIG. 4 is a vertical sectional view of a main portion along a line C—C in FIG. 1.

The upper and lower connection portions 5*a* and 5*b* are shown in FIG. 4.

Further, a throttle valve shaft 6 is rotatably arranged so as to penetrate across the first suction air passage 2 and the second suction air passage 4*a*, and a butterfly-shaped first throttle valve 7*a* opening and closing the first suction air passage 2 and a butterfly-shaped second throttle valve 7*b* opening and closing the second suction air passage 4 are attached to the throttle valve shaft 6 by screws.

Next, a description will be given of a first fuel distribution pipe 8 with reference to FIGS. 5 to 8.

Figure 5:
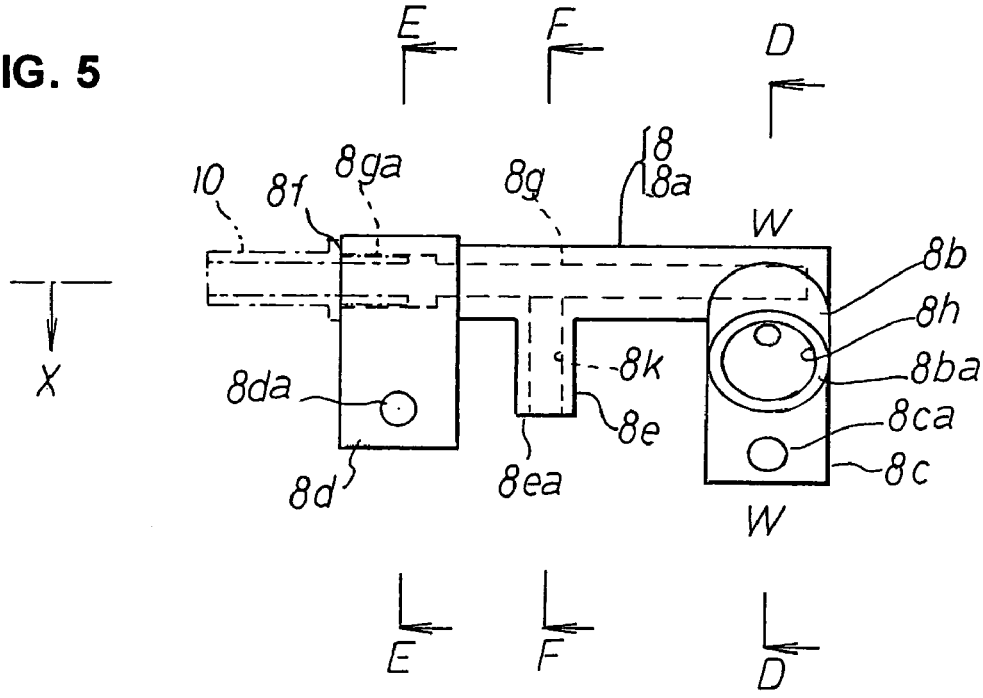
FIG. 5 is a top plan view of a first fuel distribution pipe used in FIG. 1.

Reference symbol 8*a* denotes a first fuel passage boss portion formed toward a side portion in a lateral direction in FIG. 5. The following structures are integrally formed in the first fuel passage boss portion.

Figure 6:
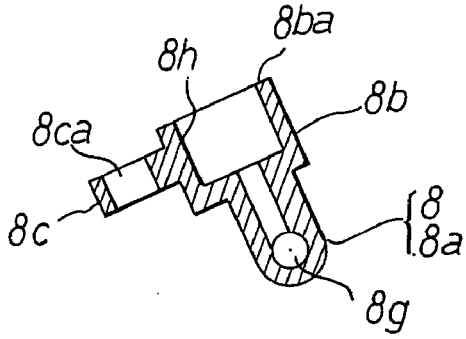
FIG. 6 is a vertical sectional view along a line D—D in FIG. 5.
Figure 7:
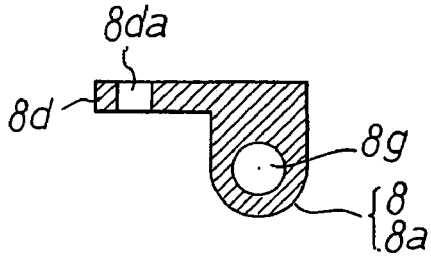
FIG. 7 is a vertical sectional view along a line E—E in FIG. 5.
Figure 8:
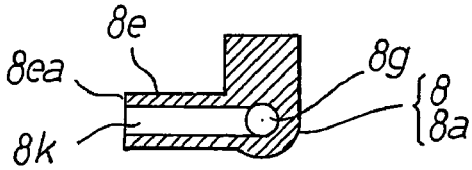
FIG. 8 is a vertical sectional view along a line F—F in FIG. 5.

A first fuel injection valve support boss portion 8*b* is formed in a right end of the first fuel passage boss portion 8*a* toward an upper side in FIG. 6.

Further, a first mounting collar portion 8*c* is formed in a right end of the first fuel passage boss portion 8*a* so as to protrude toward the other side portion X, and a second mounting collar portion 8*d* is formed in a left end so as to protrude toward the other side portion X. Further, a first fuel connection pipe portion 8*e* is formed in an approximately intermediate portion of the first fuel passage boss portion 8*a* so as to protrude toward the other side portion X.

In the description mentioned above, the other side portion X means a downward direction in the drawing. Further, a first fuel passage 8*g* is provided within the first fuel passage boss portion 8*a* so as to be directed toward a right side from a left end 8*f*.

Further, a first injection valve insertion hole 8*h* is provided from an upper end 8*ba* of the first fuel injection valve support boss portion 8*b* toward the first fuel passage 8*g* side, and a bottom portion of the first injection valve insertion hole 8*h* communicates with the first fuel passage 8*g*.

Further, a first fuel connection path 8*k* is provided from a leading end 8*ea* of the first fuel connection pipe portion 8*e* toward the first fuel passage 8*g*.

Further, a mounting hole 8*ca* is provided through in the first mounting collar portion 8*c*, and a mounting hole 8*da* is provided through in the second mounting collar portion 8*d*.

Next, a description will be given of a second fuel distribution pipe 9 with reference to FIGS. 9 to 12.

Figure 9:
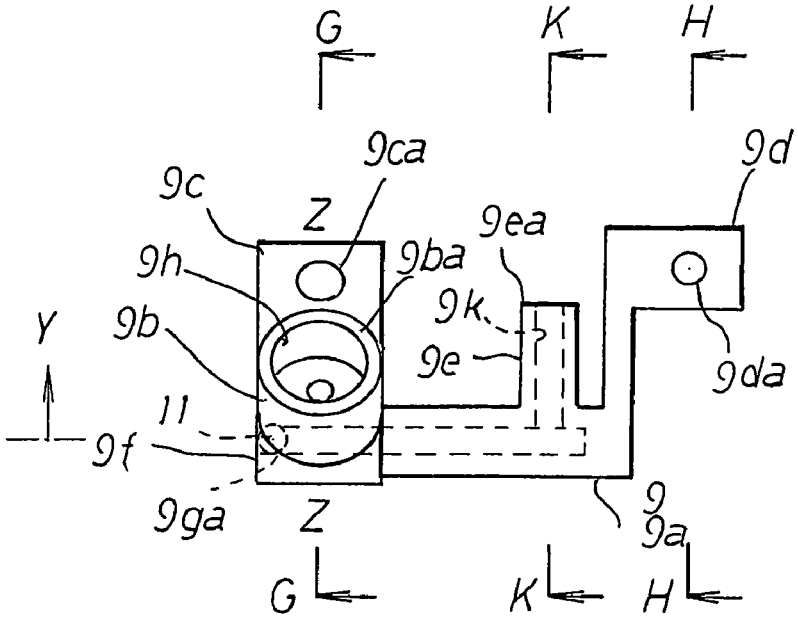
FIG. 9 is a top plan view of a second fuel distribution pipe used in FIG. 1.

Reference symbol 9*a* denotes a second fuel passage boss portion formed toward a side portion in a lateral direction in FIG. 9. The following structures are integrally formed in the second fuel passage boss portion.

Figure 10:
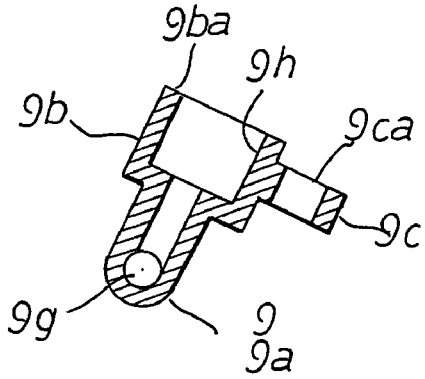
FIG. 10 is a vertical sectional view along a line G—G in FIG. 9.
Figure 11:
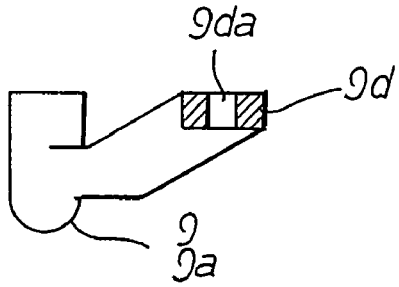
FIG. 11 is a vertical sectional view along a line H—H in FIG. 9.
Figure 12:
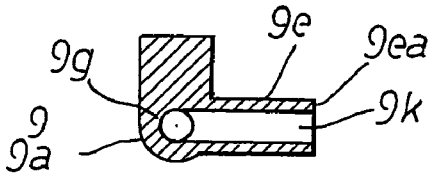
FIG. 12 is a vertical sectional view along a line K—K in FIG. 9.
Figure 13:
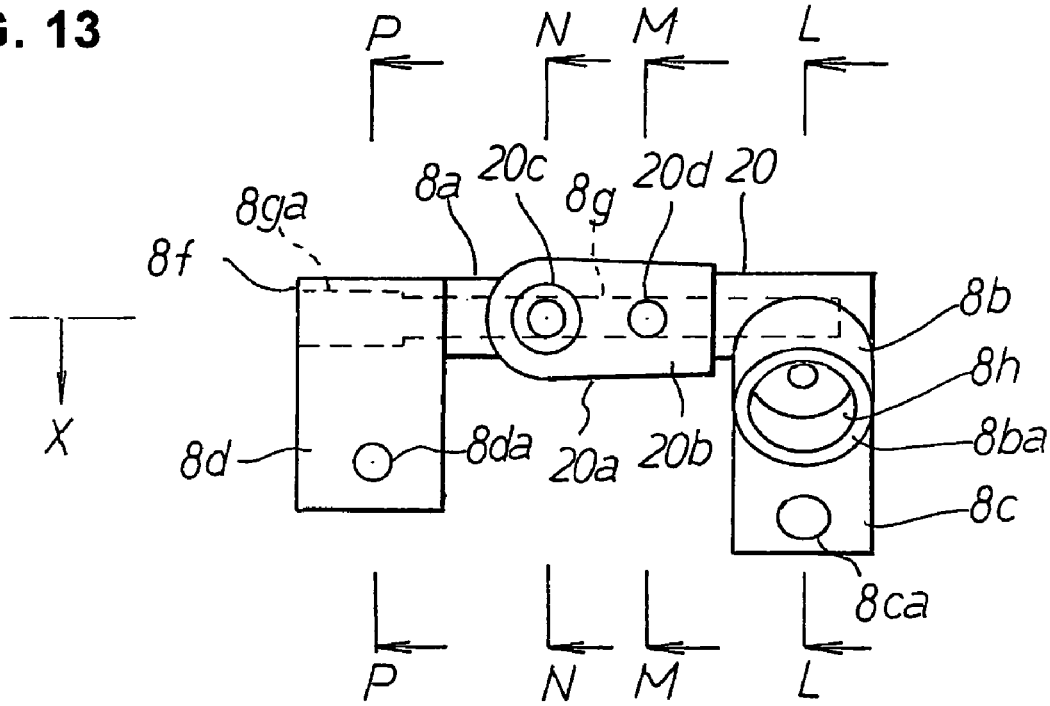
FIG. 13 is a top plan view of a first fuel distribution pipe used in a second embodiment of the throttle body for the V-type engine in accordance with the present invention.
Figure 14:
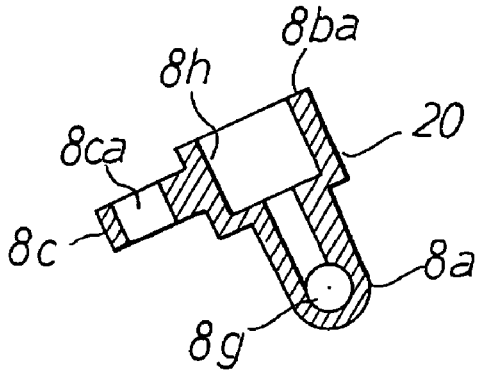
FIG. 14 is a vertical sectional view along a line L—L in FIG. 13.
Figure 15:
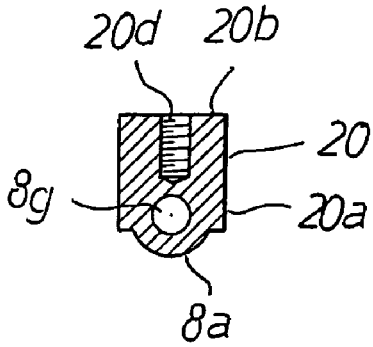
FIG. 15 is a vertical sectional view along a line M—M in FIG. 13.
Figure 16:
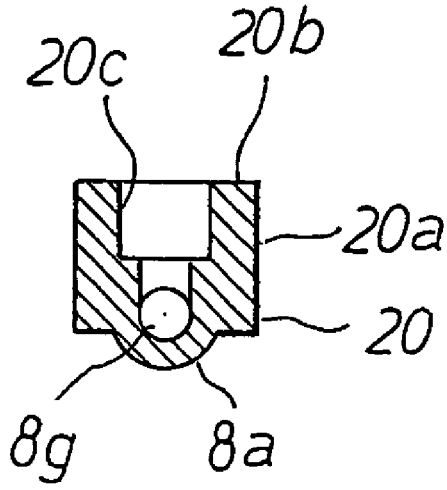
FIG. 16 is a vertical sectional view along a line N—N in FIG. 13.
Figure 17:
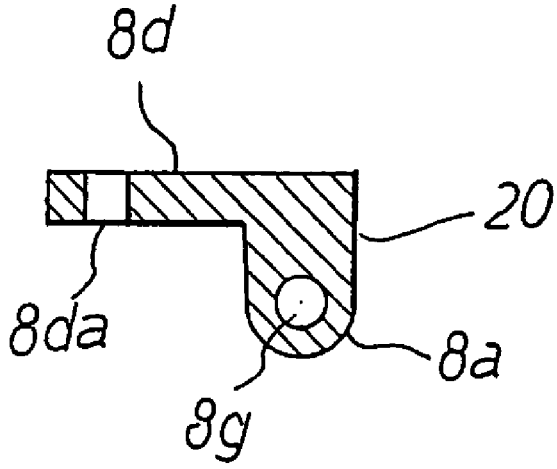
FIG. 17 is a vertical sectional view along a line P—P in FIG. 13.
Figure 18:
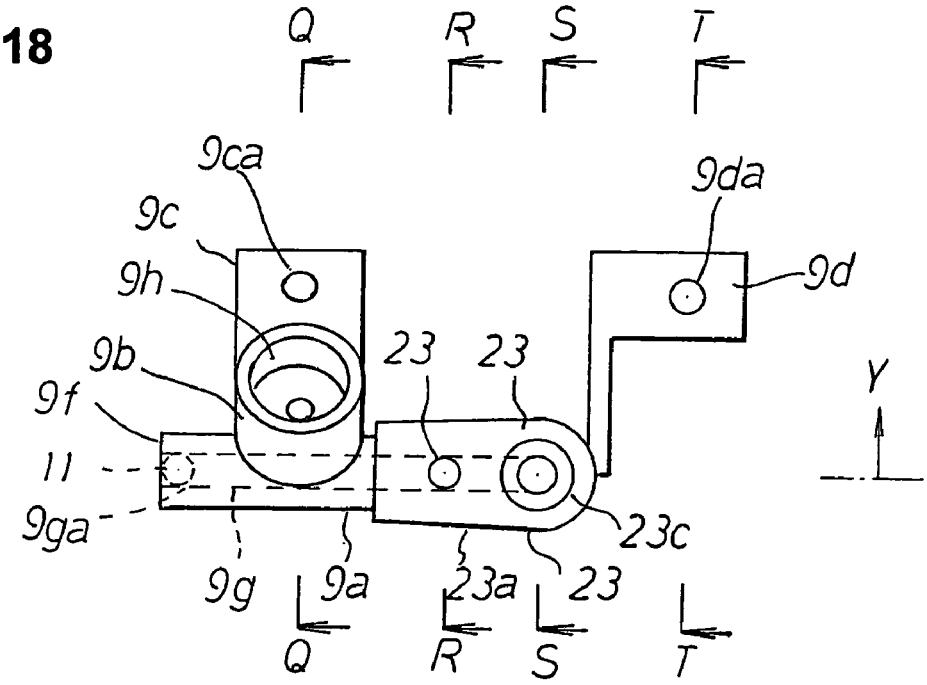
FIG. 18 is a top plan view of a second fuel distribution pipe used in the second embodiment of the throttle body for the V-type engine in accordance with the present invention.
Figure 19:
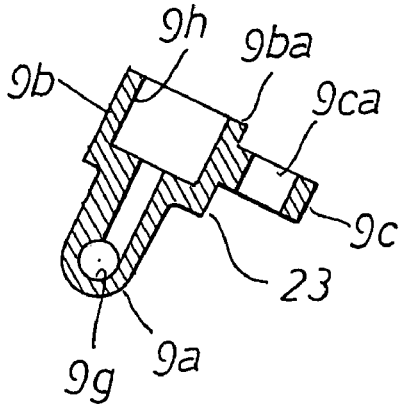
FIG. 19 is a vertical sectional view along a line Q—Q in FIG. 18.
Figure 20:
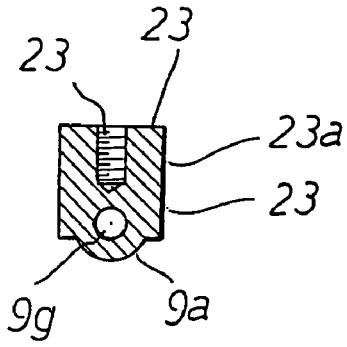
FIG. 20 is a vertical sectional view along a line R—R in FIG. 18.
Figure 21:
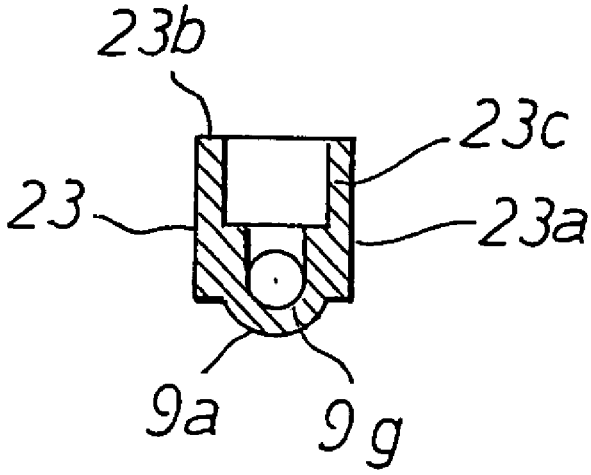
FIG. 21 is a vertical sectional view along a line S—S in FIG. 18.
Figure 22:
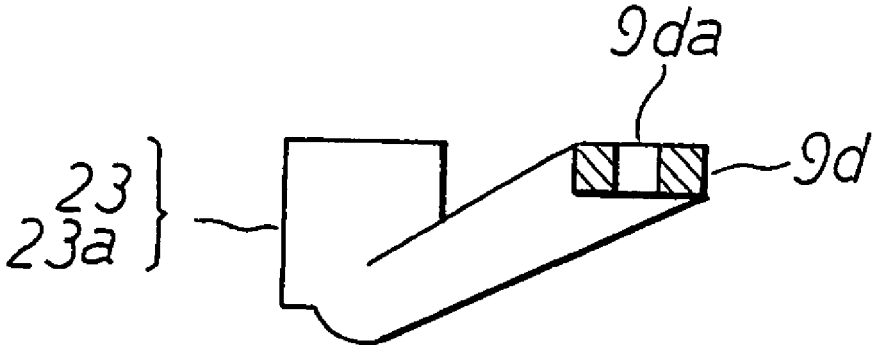
FIG. 22 is a vertical sectional view along a line T—T in FIG. 18.

A second fuel injection valve support boss portion 9*b* is formed in a left end of the second fuel passage boss portion 9*a* toward an upper side in FIG. 10.

Further, a third mounting collar portion 9*c* is formed in a left end of the second fuel passage boss portion 9*a* so as to protrude toward one side portion Y, and a fourth mounting collar portion 9*d* is formed in a right end so as to protrude toward the one side portion Y. Further, a second fuel connection pipe portion 9*e* is formed in an approximately intermediate portion of the second fuel passage boss portion 9*a* so as to protrude toward the one side portion Y.

In the description mentioned above, the one side portion Y means an upward direction in the drawing.

Further, a second fuel passage 9*g* is provided within the second fuel passage boss portion 9*a* so as to be directed toward a right side from a left end 9*f*.

Further, a second injection valve insertion hole 9*h* is provided from an upper end 9*ba* of the second fuel injection valve support boss portion 9*b* toward the second fuel passage 9*g* side, and a bottom portion of the second injection valve insertion hole 9*h* communicates with the second fuel passage 9*g*.

Further, a second fuel connection path 9*k* is provided from a leading end 9*ea* of the second fuel connection pipe portion 9*e* toward the second fuel passage 9*g*.

Further, a mounting hole 9*ca* is provided through in the third mounting collar portion 9*c*, and a mounting hole 9*da* is provided through in the fourth mounting collar portion 9*d*.

Further, a fuel inflow pipe 10 is connected to an opening portion 8*ga* of the first fuel passage 8*g* open to a left end 8*f* of the first fuel passage boss portion 8*a*, and an opening portion 9*ga* of the second fuel passage 9*g* open to a left end 9*f* of the second fuel passage boss portion 9*a* is closed by a plug 11.

Further, the first and second fuel distribution pipes 8 and 9 are fixed by screw to the first and second throttle bodies 1 and 3 in accordance with the following manner.

The first fuel distribution pipe 8 is arranged so as to face to the one side wall 1*a* of the first throttle body 1 and the one side wall 3*e* of the second throttle body 3, the first mounting collar portion 8*c* of the first fuel distribution pipe 8 is arranged on the first mounting step portion 1*c* of the first throttle body 1, and the first mounting collar portion 8*c* is screwed to the first throttle body 1 via the mounting hole 8*ca*.

Further, the second mounting collar portion 8*d* of the first fuel distribution pipe 8 is arranged so as to be brought into contact with the collar portion 3*f* extending toward the one side portion Y from the one side wall 3*e* of the second throttle body 3, and the second mounting collar portion 8*d* is screwed to the first throttle body 1 via the mounting hole 8*da*.

In accordance with the manner mentioned above, the first fuel distribution pipe 8 is fixedly arranged by screw toward the one side wall 1*a* of the first throttle body 1 and the one side wall 3*e* of the second throttle body 3. At this time, an injection side leading end portion J1*a* of a first fuel injection valve J1 is arranged so as to be inserted to the first injection valve insertion hole 1*b*, and an inflow side end portion J1*b* is arranged so as to be inserted to the first injection valve insertion hole 8*h* of the first fuel distribution pipe 8.

Figure 2:
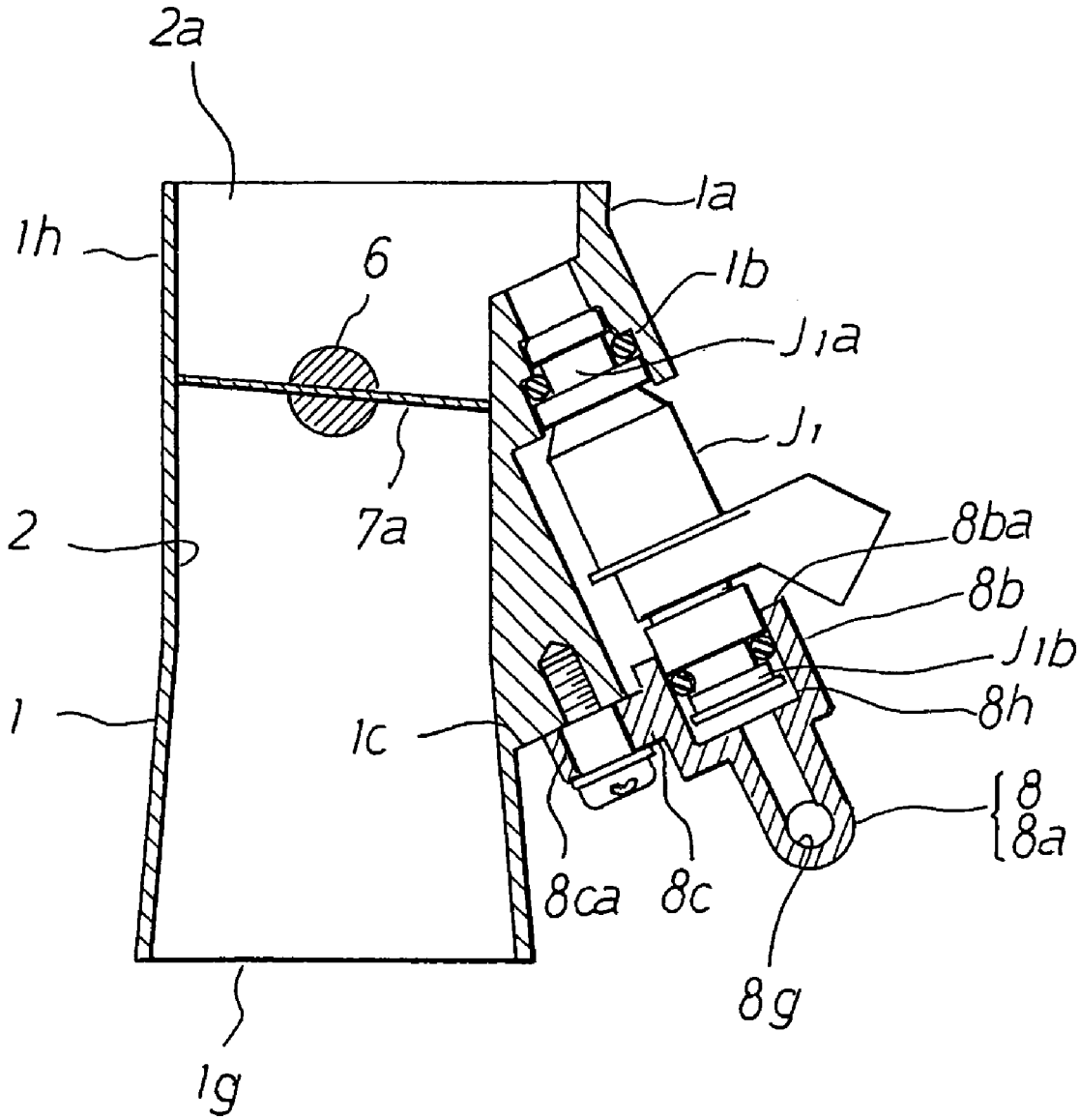
FIG. 2 is a vertical sectional view of a main portion along a line A—A in FIG. 1.

In accordance with the structure mentioned above, the first fuel injection valve J1 is pinched by the first fuel distribution pipe 8 and the first throttle body 1 (this is shown in FIG. 2). Further, the first fuel connection pipe portion 8*e* is directed toward the other side portion X, is positioned above the inflow ends 1*g* and 3*g* of the first and second throttle bodies 1 and 3, and is arranged between the facing walls 1*d* and 3*d* of the first and second throttle bodies 1 and 3 (in this case, the upstream side mentioned above means an upstream side of an air flow directed to the suction air passages 2 and 4).

The second fuel distribution pipe 9 is arranged so as to face to the other side wall 1*h* of the first throttle body 1 and the other side wall 3*a* of the second throttle body 3, the third mounting collar portion 9*c* of the second fuel distribution pipe 9 is arranged on the second mounting step portion 3*c* of the second throttle body 3, and the third mounting collar portion 9*c* is screwed to the second throttle body 3 via the mounting hole 9*ca*.

Further, the fourth mounting collar portion 9*d* of the second fuel distribution pipe 9 is arranged so as to be brought into contact with the collar portion 1*k* extending toward the other side portion X from the other side wall 1*h* of the first throttle body 1, and the fourth mounting collar portion 9*d* is screwed to the first throttle body 1 via the mounting hole 9*da*.

In accordance with the manner mentioned above, the second fuel distribution pipe 9 is fixedly arranged by screw toward the other side wall 1*h* of the first throttle body 1 and the other side wall 3*a* of the second throttle body 3. At this time, an injection side leading end portion J2*a* of a second fuel injection valve J2 is arranged so as to be inserted to the second injection valve insertion hole 3*b*, and an inflow side end portion J2*b* is arranged so as to be inserted to the second injection valve insertion hole 9*h* of the second fuel distribution pipe 9.

Figure 3:
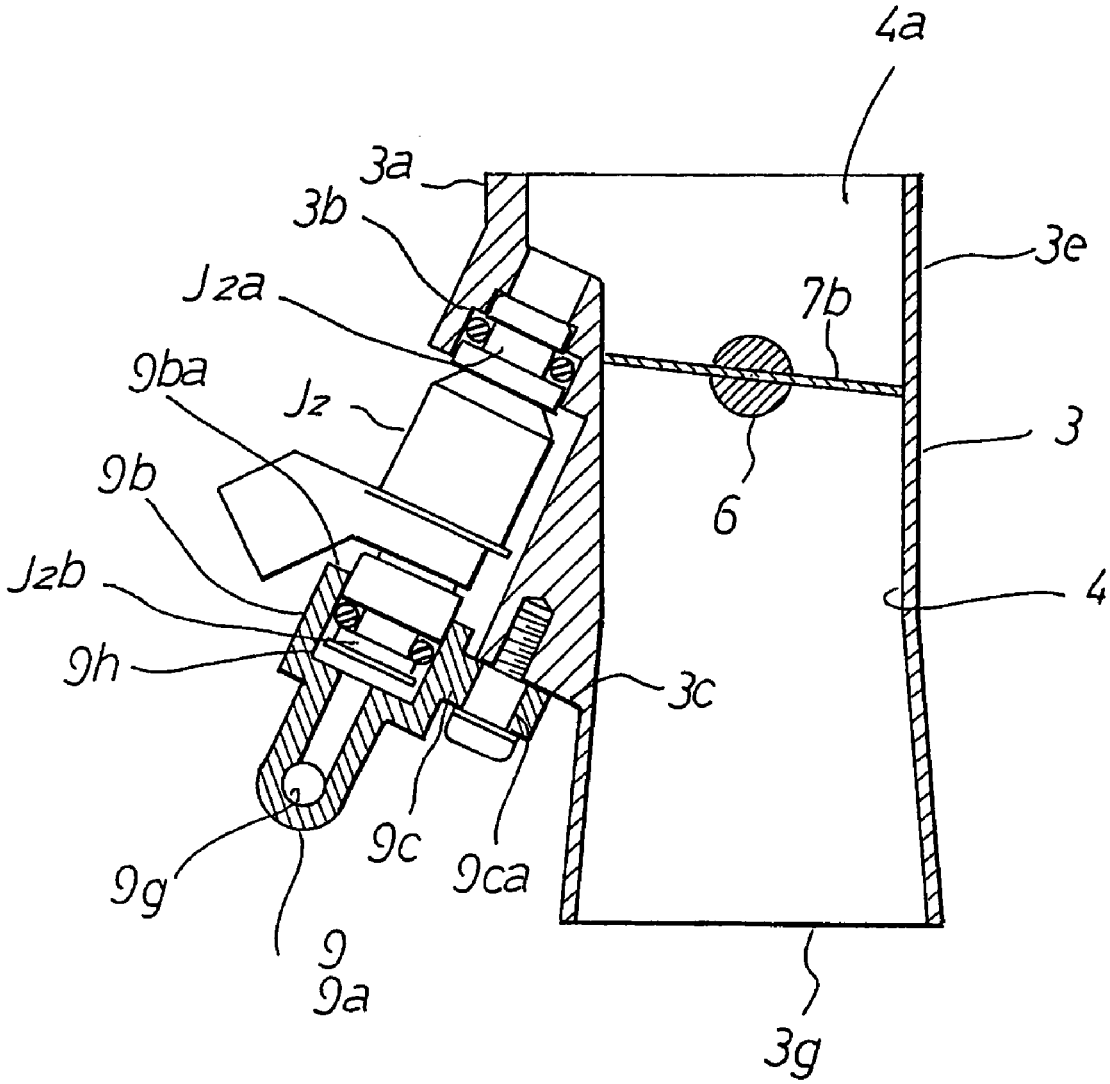
FIG. 3 is a vertical sectional view of a main portion along a line B—B in FIG. 1.

In accordance with the structure mentioned above, the second fuel injection valve J2 is pinched by the second fuel distribution pipe 9 and the second throttle body 3 (this is shown in FIG. 3) Further, the second fuel connection pipe portion 9*e* is directed toward the one side portion Y, is positioned above the inflow ends 1*g* and 3*g* of the first and second throttle bodies 1 and 3, and is arranged between the facing walls 1*d* and 3*d* of the first and second throttle bodies 1 and 3.

Next, the first fuel connection pipe portion 8*e* extending to the other side portion X of the first fuel distribution pipe 8 and the second fuel connection pipe portion 9*e* extending to the one side portion Y of the second fuel distribution pipe 9 are connected by a fuel coupling pipe 13. In this case, an outer periphery of an end portion toward the one side portion Y of the fuel coupling pipe 13 is fastened to the first fuel connection pipe portion 8*e* by a fastening member 14*a*, and an outer periphery of an end portion toward the other side portion X of the fuel coupling pipe 13 is fastened to the second fuel connection pipe portion 9*e* by a fastening member 14*b*.

In accordance with the manner mentioned above, the throttle body for the V-type engine is formed, and the throttle body mentioned above is arranged within a V bank.

Further, the fuel boosted by a fuel pump (not shown) is supplied into the first fuel passage 8*g* of the first fuel distribution pipe 8 from a fuel inflow pipe 10, and a part of the fuel within the first fuel passage 8*g* is supplied to the first fuel injection valve J1 from the first injection valve insertion hole 8*h*, and is injected and supplied toward the first suction air passage 2*a* in a downstream side of the first throttle body 7*a* from the injection side leading end portion J1*a*.

On the other hand, the other of the fuel within the first fuel passage 8*g* is supplied to the second fuel passage 9*g* of the second fuel distribution pipe 9 via the first fuel connection path 8*k*, the fuel coupling pipe 13 and the second fuel connection path 9*k*, then supplied to the second fuel injection valve J2 from the second injection valve insertion hole 9*h* and is injected and supplied toward an inner side of the second suction air passage 4*a* in a downstream side of the second throttle valve 7*b* from the injection side leading end portion J2*a*.

In accordance with the throttle body as mentioned above, since the fuel coupling pipe 13 is arranged at the upper position than the inflow ends 1*g* and 3*g* of the first and second throttle bodies 1 and 3 and is arranged between the facing walls 1*d* and 3*d* of the first and second throttle bodies 1 and 3, the fuel coupling pipe 13 does not interfere with the other structure portions of the V-type engine, and it is possible to improve a freedom for designing of the passage.

Further, since it is possible to arrange the longitudinal axial direction of the fuel coupling pipe 13 apart from the cylinder of the V-type engine, it is possible to prevent the fuel within the fuel coupling pipe 13 from being heated and increased in temperature due to heat of the cylinder.

Further, since the fuel coupling pipe 13 is arranged between the facing walls 1*d* and 3*d* of the first and second throttle bodies 1 and 3, and the outer peripheral portion thereof is protected by the facing walls 1*d* and 3*d*, the fuel coupling pipe 13 is not brought into contact with the obstacles at a time of being mounted on the two-wheeled vehicle so as to be detached, and the fuel coupling pipe 13 is not directly exposed to the outer side, so that it is possible to improve an outer appearance of the two-wheeled vehicle.

Further, since the first fuel connection pipe portion 8*e* is integrally formed with the first fuel distribution pipe 8, and the second fuel connection pipe portion 9*e* is integrally formed with the second fuel distribution pipe 9, it is not necessary to individually attach the respective fuel connection pipe portions 8*e* and 9*e* to the throttle bodies 1 and 3. Accordingly, it is possible to reduce the number of parts and a mounting work.

Next, a description will be given of a second embodiment in accordance with the present invention.

A description will be given of a first fuel distribution pipe 20 on the basis of FIGS. 13 to 17.

A description will be given of different portions from the first fuel distribution pipe 8 shown in FIGS. 5 to 8, and a description of the same structure portions will be omitted by using the same reference numerals.

Reference symbol 20*a* denotes a first fuel connection pipe mounting boss portion formed so as to protrude toward an upper side from the first fuel passage boss portion 8*a*. A first mounting surface 20*b* forming a flat surface is formed in an upper end of the first fuel connection pipe mounting boss portion 20*a*.

A first fuel connection pipe insertion hole 20*c* and a thread hole 20*d* are provided in the first mounting surface 20*b* so as to be open.

Further, a bottom portion of the first fuel connection pipe insertion hole communicates with the first fuel passage 8*g*.

Further, a description will be given of a second fuel distribution pipe 23 with reference to FIGS. 18 to 22.

A description will be given of different portions from the second fuel distribution pipe 9 shown in FIGS. 9 to 12, and a description of the same structure portions will be omitted by using the same reference numerals.

Reference symbol 23*a* denotes a second fuel connection pipe mounting boss portion formed so as to protrude toward an upper side from the second fuel passage boss portion 9*a*. A second mounting surface 23*b* forming a flat surface is formed in an upper end of the second fuel connection pipe mounting boss portion 23*a*.

Further, a second fuel connection pipe insertion hole 23*c* and a thread hole 23*d* are provided in the second mounting surface 23*b* so as to be open.

Further, a bottom portion of the second fuel connection pipe insertion hole communicates with the second fuel passage 9*g*.

Figure 23:
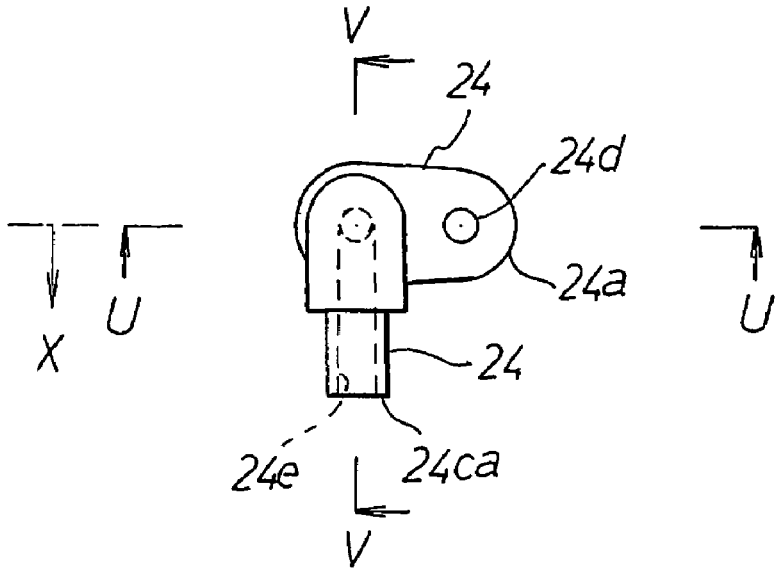
FIG. 23 is a top plan view of a first fuel connection pipe.
Figure 24:
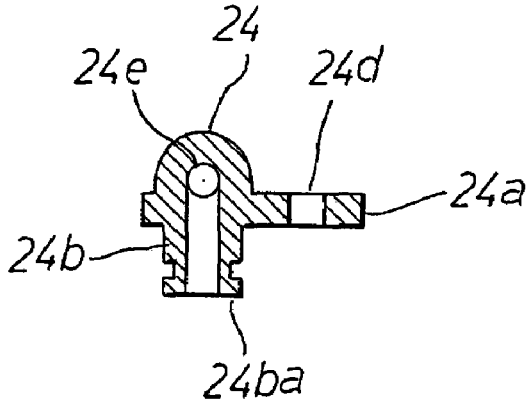
FIG. 24 is a vertical sectional view along a line U—U in FIG. 23.
Figure 25:
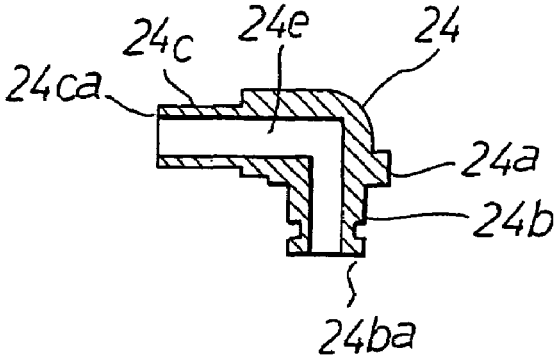
FIG. 25 is a vertical sectional view along a line V—V in FIG. 23.

Next, a description will be given of a first fuel connection pipe 24 attached to the first fuel connection pipe mounting boss portion 20*a* with reference to FIGS. 23 to 25.

The first fuel connection pipe 24 is formed by a collar portion 24*a* formed in a flat shape, a first insertion boss 24*b* protruding toward a lower side from a lower surface of the collar portion 24*a*, and a first fuel outlet pipe portion 24*c* protruding toward the other side portion X from the collar portion 24*a*, a mounting hole 24*d* is provided through in the collar portion 24*a*, and a first fuel connection path 24*e* is provided toward a leading end 24*ca* of the first fuel outlet pipe portion 24*c* from a lower end 24*ba* of the first insertion boss 24*b*.

Figure 26:
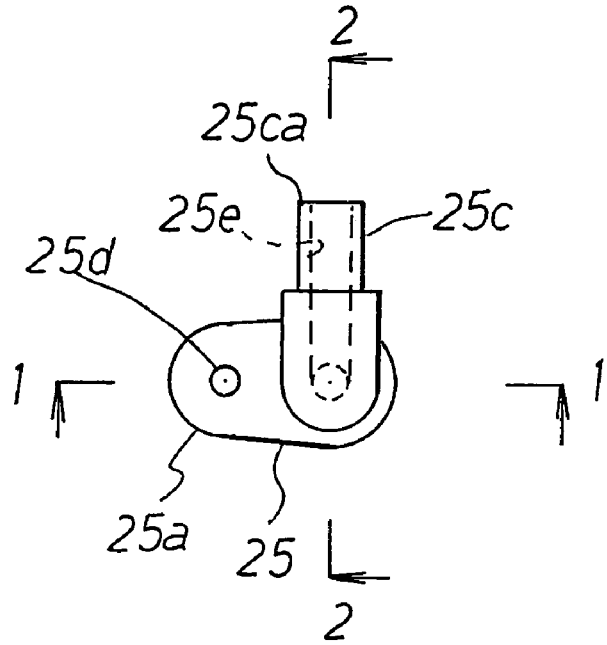
FIG. 26 is a top plan view of a second fuel connection pipe.
Figure 27:
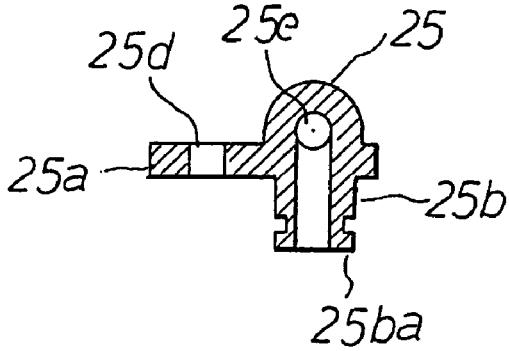
FIG. 27 is a vertical sectional view along a line 1—1 in FIG. 26.
Figure 28:
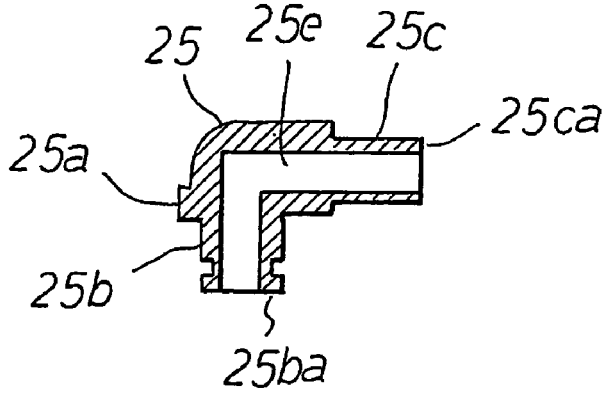
FIG. 28 is a vertical sectional view along a line 2—2 in FIG. 26.
Figure 29:
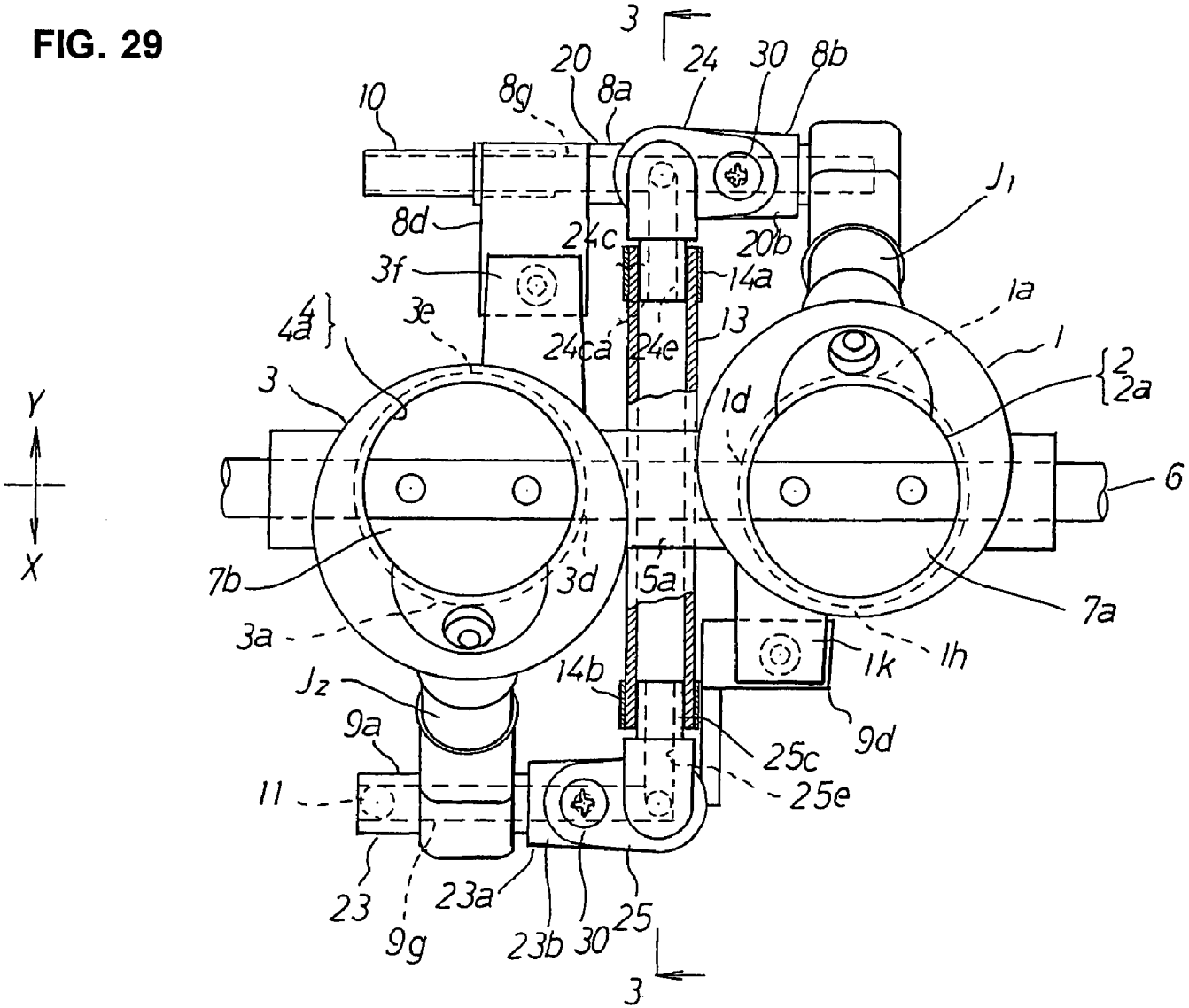
FIG. 29 is a top plan view showing a second embodiment of the throttle body for the V-type engine in accordance with the present invention.
Figure 30:
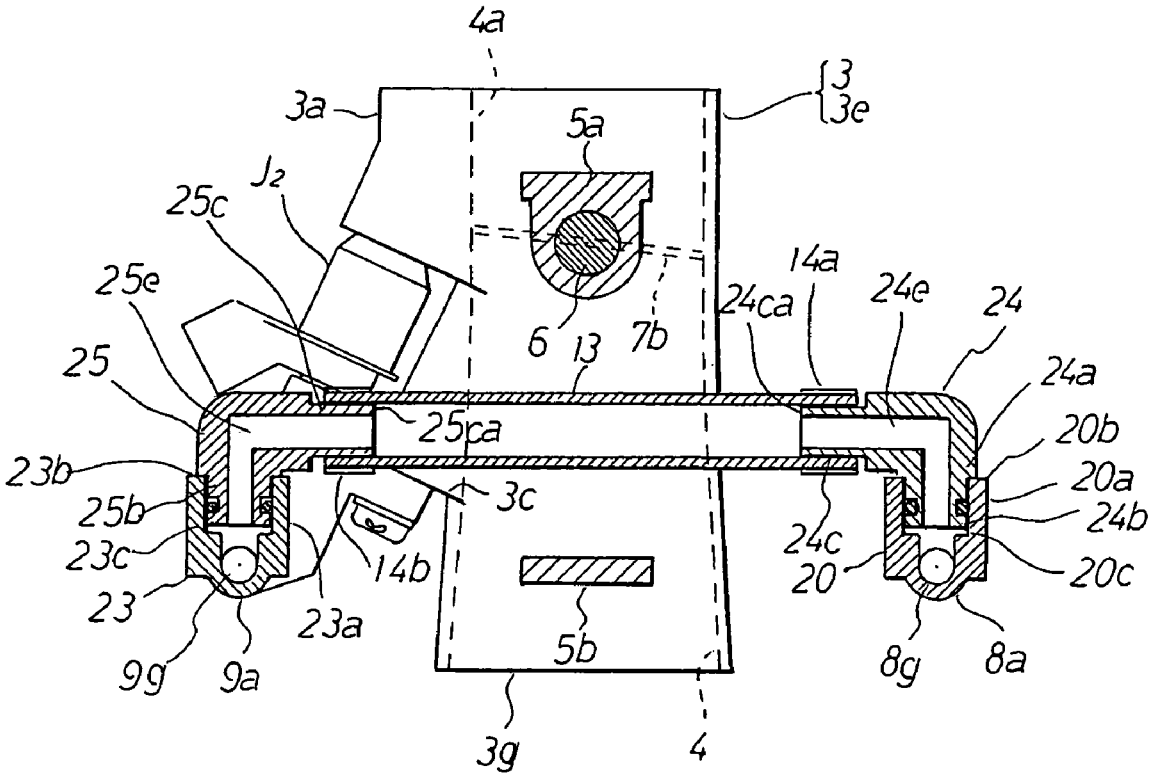
FIG. 30 is a vertical sectional view along a line 3—3 in FIG. 29.

Next, a description will be given of a second fuel connection pipe 25 attached to the second fuel connection pipe mounting boss portion 23*a* with reference to FIGS. 26 to 28.

The second fuel connection pipe 25 is formed by a collar portion 25*a* formed in a flat shape, a second insertion boss 25*b* protruding toward a lower side from a lower surface of the collar portion 25*a*, and a second fuel outlet pipe portion 25*c* protruding toward the one side portion Y from the collar portion 25*a*, a mounting hole 25*d* is provided through in the collar portion 25*a*, and a second fuel connection path 25*e* is provided toward a leading end 25*ca* of the second fuel outlet pipe portion 25*c* from a lower end 25*ba* of the second insertion boss 25*b*.

The first fuel distribution pipe 20 mentioned above is screwed to the one side wall 1*a* of the first throttle body 1 via the mounting hole 8*ca* of the first mounting collar portion 8*c*, and is screwed to the one side wall 3*e* of the second throttle body 3 via the mounting hole 8*da* of the second mounting collar portion 8*d*.

In this case, the first fuel injection valve J1 is supported by the first injection valve insertion hole 8*h* of the first fuel distribution pipe and the first injection valve leading end insertion hole 1*b* of the first throttle body 1 in the manner mentioned above.

Further, the second fuel distribution pipe 23 is screwed to the other side wall 3*a* of the second throttle body 3 via the mounting hole 9*ca* of the third mounting collar portion 9*c*, and is screwed to the other side wall 1*h* of the first throttle body 3 via the mounting hole 9*da* of the fourth mounting collar portion 9*d*.

In this case, the second fuel injection valve J2 is supported by the second injection valve insertion hole 9*h* of the second fuel distribution pipe 23 and the second injection valve leading end insertion hole 3*b* of the second throttle body 3 in the manner mentioned above.

On the other hand, the first fuel outlet pipe portion 24*c* of the first fuel connection pipe 24 and the second fuel outlet pipe portion 25*c* of the second fuel connection pipe 25 can be previously connected by the fuel coupling pipe 13, and both ends of the fuel coupling pipe 13 are fastened by the fastening members 14*a* and 14*b* in the same manner as the embodiment mentioned above.

Further, the first insertion boss 24*b* of the first fuel connection pipe 24 to which one end of the fuel coupling pipe 13 is connected is arranged so as to be inserted into the first fuel connection pipe insertion hole 20*c* of the first fuel distribution pie 20, the collar portion 24*a* is arranged on the first mounting surface 20*b* of the first fuel connection pipe mounting boss portion 20*a*, and a screw 30 is screwed into the thread hole 20*d* from the mounting hole 24*d* of the first fuel connection pipe 24 in this state.

Further, the second insertion boss 25*b* of the second fuel connection pipe 25 to which the other end of the fuel coupling pipe 13 is connected is arranged so as to be inserted into the second fuel connection pipe insertion hole 23*c* of the second fuel distribution pipe 23, the collar portion 25*a* is arranged on the second mounting surface 23*b* of the second fuel connection pipe mounting boss portion 23*a*, and a screw 31 is screwed into the thread hole 23*d* from the mounting hole 25*d* of the second fuel connection pipe 25 in this state.

In accordance with the second embodiment mentioned above, since the fuel coupling pipe 13 is previously arranged in the first and second fuel connection pipes 24 and 25, it is particularly possible to largely improve a mounting workability of the fuel coupling pipe 13.

Further, since it is sufficient to detach the first and second fuel connection pipes 24 and 25 from the first and second fuel distribution pipes 20 and 23 at a time of the maintenance of the fuel coupling pipe 13, and the first and second fuel distribution pipes 20 and 23 can be kept being attached to the first and second throttle bodies 1 and 3, it is possible to largely improve a maintenance workability of the fuel coupling pipe 13.

Then, a description will be again given of the first fuel distribution pipe 8 by returning to FIG. 5. Since the mounting hole 8*ca* of the first mounting collar portion 8*c* is arranged in the right side of the first fuel connection pipe portion 8*e* and is arranged on a longitudinal axis W—W of the first injection valve insertion hole 8*h*, and the mounting hole 8*da* of the second mounting collar portion 8*d* is arranged in the left side of the first fuel connection pipe portion 8*e*, the external force is applied to the first fuel distribution pipe 8 at a time of inserting one end of the fuel coupling pipe 13 to the first fuel connection pipe portion 8*e* so as to fasten by the fastening member 14*a*, however, both the right and left end portions of the first fuel connection pipe portion 8*e* are fixed. Accordingly, it is possible to firmly fix the first fuel distribution pipe 8 to the first and second throttle bodies 1 and 3.

Particularly, since the mounting hole 8*ca* of the first mounting collar portion 8*c* is arranged on the longitudinal axis W—W of the first injection valve insertion hole 8*h*, it is possible to further accurately fix the first injection valve insertion hole 8*h*, and it is possible to improve an airtightness between the inflow side end portion J1*b* of the first fuel injection valve J and the first injection valve insertion hole 8*h*.

Further, a description will be given of the second fuel distribution pipe 9 by returning to FIG. 9. Since the mounting hole 9*ca* of the third mounting collar portion 9*c* is arranged in the left side of the second fuel connection pipe portion 9*e* and is arranged on a longitudinal axis Z—Z of the second injection valve insertion hole 9*h*, and the mounting hole 9*da* of the fourth mounting collar portion 9*d* is arranged in the right side of the second fuel connection pipe portion 9*e*, the external force is applied to the second fuel distribution pipe 9 at a time of inserting the other end of the fuel coupling pipe 13 to the second fuel connection pipe portion 9*e* so as to fasten by the fastening member 14*b*, however, both the right and left end portions of the second fuel connection pipe portion 9*e* are fixed. Accordingly, it is possible to firmly fix the second fuel distribution pipe 9 to the first and second throttle bodies 1 and 3.

Particularly, since the mounting hole 9*ca* of the third mounting collar portion 9*c* is arranged on the longitudinal axis Z—Z of the second injection valve insertion hole 9*h*, it is possible to further accurately fix the second injection valve insertion hole 9*h*, and it is possible to improve an airtightness between the inflow side end portion J2*b* of the second fuel injection valve J2 and the second injection valve insertion hole 9*h*.

What is claimed is:

1. A throttle body for a V-type engine comprising:

a first throttle body in which a first suction air passage is provided through;

a second throttle body in which a second suction air passage is provided through, the first throttle body and the second throttle body being arranged adjacently in sideward parallel to each other;

a throttle valve shaft arranged so as to penetrate across the first suction air passage and the second suction air passage;

a first throttle valve opening and closing the first suction air passage;

a second throttle valve opening and closing the second suction air passage, the first throttle valve and the second throttle valve being attached to the throttle valve shaft;

a first fuel injection valve which is open toward a suction air passage in a downstream side of the first throttle valve, and is attached to one side wall of the first throttle body; and a second fuel injection valve which is open toward a suction air passage in a downstream side of the second throttle valve, and is attached to the other side wall of the second throttle body, wherein a first fuel distribution pipe is formed by a first fuel passage boss portion formed toward a side portion, a first fuel injection valve support boss portion formed so as to protrude toward an upper side from the first fuel passage boss portion, first and second mounting collar portions protruding toward the other side portion (X) from the first fuel passage boss portion and having a mounting hole provided therein, and a first fuel connection pipe portion protruding toward the other side portion (X) from the first fuel passage boss portion, wherein a first fuel passage is provided in the first fuel passage boss portion toward a side portion, wherein a first injection valve insertion hole connected to the first fuel passage and open toward an upper end is provided in the first fuel injection valve support boss portion, wherein a first fuel connection path is provided in the first fuel connection pipe portion from a leading end toward the first fuel passage, wherein a second fuel distribution pipe is formed by a second fuel passage boss portion formed toward a side portion, a second fuel injection valve support boss portion formed so as to protrude toward an upper side from the second fuel passage boss portion, third and fourth mounting collar portions protruding toward one side portion (Y) from the second fuel passage boss portion and having a mounting hole provided therein, and a second fuel connection pipe portion protruding toward the one side portion (Y) from the second fuel passage boss portion, wherein a second fuel passage is provided in the second fuel passage boss portion toward a side portion, wherein a second injection valve insertion hole connected to the second fuel passage and open toward an upper end is provided in the second fuel injection valve support boss portion, wherein a second fuel connection path is provided in the second fuel connection pipe portion from a leading end toward the second fuel passage, wherein an inflow side end portion of the first fuel injection valve is arranged so as to be inserted into the first injection valve insertion hole of the first fuel injection valve support boss portion by arranging said first fuel distribution pipe so as to face to the one side walls of the first and second throttle bodies and fixing by screw to the one side walls of the first and second throttle bodies via the mounting holes of the first and second mounting collar portions, wherein the first fuel connection pipe portion is arranged above inflow ends of the first and second throttle bodies and between facing walls of the first and second throttle bodies, wherein an inflow side end portion of the second fuel injection valve is arranged so as to be inserted into the second injection valve insertion hole of the second fuel injection valve support boss portion by arranging said second fuel distribution pipe so as to face to the other side walls of the first and second throttle bodies and fixing by screw to the other side walls of the first and second throttle bodies via the mounting holes of the third and fourth mounting collar portions, wherein the second fuel connection pipe portion is arranged above inflow ends of the first and second throttle bodies and between the facing walls of the first and second throttle bodies, wherein a fuel inflow pipe connected to a fuel pump is arranged so as to be connected to an opening portion to an end portion of the first fuel passage boss portion in the first fuel passage, and wherein the first and second fuel connection pipe portions are arranged so as to be connected by a fuel coupling pipe.

2. The throttle body for the V-type engine comprising:

the first throttle body in which the first suction air passage is provided through;

the second throttle body in which the second suction air passage provided through, the first throttle body and the second throttle body being arranged adjacently in sideward parallel to each other;

the throttle valve shaft arranged so as to penetrate across the first suction air passage and the second suction air passage;

the first throttle valve opening and closing the first suction air passage;

the second throttle valve opening and closing the second suction air passage, the first throttle valve and the second throttle valve being attached to the throttle valve shaft;

the first fuel injection valve which is open toward the suction air passage in the downstream side of the first throttle valve and is attached to one side wall of the first throttle body; and the second fuel injection valve which is open toward the suction air passage in the downstream side of the second throttle valve and is attached to the other side wall of the second throttle body, wherein a first fuel distribution pipe is formed by the first fuel passage boss portion formed toward a side portion, the first fuel injection valve support boss portion formed so as to protrude toward an upper side from the first fuel passage boss portion, first and second mounting collar portions protruding toward the other side portion (X) from the first fuel passage boss portion and having the mounting hole provided therein, and a first fuel connection pipe mounting boss portion protruding toward an upper side from the first fuel passage boss portion and forming a first mounting surface in an upper portion thereof, wherein the first fuel passage is provided in the first fuel passage boss portion toward a side portion, wherein the first injection valve insertion hole connected to the first fuel passage and open toward an upper end is provided in the first fuel injection valve support boss portion, wherein a first fuel connection pipe insertion hole connected to the first fuel passage and a thread hole are provided in the first mounting surface of the first fuel connection pipe mounting boss portion, wherein the first fuel connection pipe is provided with a collar portion, a first insertion boss protruding toward a lower side from the collar portion and a first fuel outlet pipe portion protruding toward the other side portion (X) from the collar portion, wherein a first fuel connection path is provided toward a leading end of the first fuel outlet pipe portion from a lower end of the first insertion boss, wherein a mounting hole is provided in the collar portion, wherein the second fuel distribution pipe is formed by the second fuel passage boss portion formed toward a side portion, the second fuel injection valve support boss portion formed so as to protrude toward an upper side from the second fuel passage boss portion, third and fourth mounting collar portions protruding toward one side portion (Y) from the second fuel passage boss portion and having the mounting hole provided therein, and a second fuel connection pipe mounting boss portion protruding toward an upper side from the second fuel passage boss portion and forming a second mounting surface in an upper portion thereof, wherein the second fuel passage is provided in the second fuel passage boss portion toward a side portion, wherein the second injection valve insertion hole connected to the second fuel passage and open toward the upper end is provided in the second fuel injection valve support boss portion, wherein a second fuel connection pipe insertion hole connected to the second fuel passage and a thread hole are provided in the second mounting surface of the second fuel connection pipe mounting boss portion, wherein the second fuel connection pipe is provided with a collar portion, a second insertion boss protruding toward a lower side from the collar portion and a second fuel outlet pipe portion protruding toward the one side portion from the collar portion, wherein a second fuel connection path is provided toward a leading end of the second fuel outlet pipe portion from a lower end of the second insertion boss, wherein a mounting hole is provided in the collar portion, wherein the inflow side end portion of the first fuel injection valve is arranged so as to be inserted into the first injection valve insertion hole of the first fuel injection valve support boss portion by arranging said first fuel distribution pipe so as to face to the one side walls of the first and second throttle bodies and fixing by screw to the one side walls of the first and second throttle bodies via the mounting holes of the first and second mounting collar portions, wherein the first insertion boss of the first fuel connection pipe is fixedly arranged so as to be inserted into the first fuel connection pipe insertion hole by screwing the collar portion of the first fuel connection pipe onto the first mounting surface of the first fuel distribution pipe, wherein the inflow side end portion of the second fuel injection valve is arranged so as to be inserted into the second injection valve insertion hole of the second fuel injection valve support boss portion by arranging the second fuel distribution pipe so as to face to the other side walls of the first and second throttle bodies and fixing by screw to the other side walls of the first and second throttle bodies via the mounting holes of the third and fourth mounting collar portions, wherein the second insertion boss of the second fuel connection pipe is fixedly arranged so as to be inserted into the second fuel connection pipe insertion hole by screwing the collar portion of the second fuel connection pipe onto the second mounting surface of the second fuel distribution pipe, wherein the fuel inflow pipe connected to the fuel pump is arranged so as to be connected to an opening portion to the end portion of the first fuel passage boss portion in the first fuel passage, and wherein the first fuel outlet pipe portion and the second fuel outlet pipe portion arranged in an upper side from the inflow ends of the first and second throttle bodies and so as to face to each other between the facing walls of the first and second throttle bodies are connected to the fuel coupling pipe.

3. The throttle body for the V-type engine as claimed in claim 1, wherein the mounting hole provided in the first mounting collar portion of said first fuel distribution pipe is formed in a right side of the first fuel connection pipe portion and along a longitudinal axis of the first injection valve insertion hole of the first fuel injection valve support boss portion, the mounting hole provided in the second mounting collar portion is formed in a left side of the first fuel connection pipe portion, the mounting hole provided in the third mounting collar portion of the second fuel distribution pipe is formed in a left side of the second fuel connection pipe portion and along a longitudinal axis of the second injection valve insertion hole of the second fuel injection valve support boss portion, and the mounting hole provided in the fourth mounting collar portion is formed in a right side of the second fuel connection pipe portion.

* * * * *